US005218159A

United States Patent [19]

McClish

[11] Patent Number: 5,218,159

[45] Date of Patent: Jun. 8, 1993

[54] ELASTIC PICKUP SADDLE FOR STRINGED INSTRUMENTS

[76] Inventor: Richard E. D. McClish, 1739 Addison #15, Berkeley, Calif. 94703

[21] Appl. No.: 824,107

[22] Filed: Jan. 22, 1992

[51] Int. Cl.[5] ..... G10H 3/18

[52] U.S. Cl. ..... 84/731

[58] Field of Search ..... 84/730, 731, 734, 743, 84/723, 726

[56] References Cited

U.S. PATENT DOCUMENTS

| | | | |
|---|---|---|---|
| 4,211,139 | 7/1980 | Murakami | 84/DIG. 24 X |
| 4,314,495 | 2/1982 | Baggs | 84/731 |
| 4,491,051 | 1/1985 | Barcus | 84/731 |
| 4,750,397 | 6/1988 | Ashworth-Jones | 84/DIG. 24 X |
| 4,903,566 | 2/1990 | McClish | 84/734 |
| 4,911,054 | 3/1990 | McClish | 84/725 |
| 4,916,350 | 4/1990 | Madden et al. | 84/DIG. 24 X |

*Primary Examiner*—William M. Shoop, Jr.
*Assistant Examiner*—Jeffrey W. Donels

[57] ABSTRACT

An elastic pickup saddle for the bridge of a stringed musical instrument uses the anti-nodal area of a flexible elastic member therein to support an elastic vibratable string. The elastic member may be a beam, a span, a plate, a diaphragm, or a composite structure acting mechanically in a similar manner. The loaded anti-nodal area of the elastic member flexes between at least two nodal points of support. The elastic member is pre-stressed and deformed by a relatively static string pressure proportional to the string's tension. When string and/or body vibrations modulate this relatively static pressure, the pre-stressed elastic member interacts mechanically with the string, thus disturbing those vibrations. A piezoelectric strain sensor monitors the flexions of the elastic member and produces an enriched tone signal in response to the disturbed string and/or body vibrations. The flexible member is supported by a massive element typically including the bridge and a portion of the instrument body.

11 Claims, 2 Drawing Sheets

ELASTIC PICKUP SADDLE FOR STRINGED INSTRUMENTS

TECHNICAL FIELD

The present invention relates to musical instruments and more specifically to elastic transducers for use in electrically amplified stringed instruments.

BACKGROUND OF THE INVENTION

Electromechanical transducers are commonly used in connection with stringed musical instruments, especially in the bridge of electrically amplified guitars and the like. The most versatile configuration for a bridge pickup is that which produces independent string signals. This allows the sound of each string to be individually processed and also allows the sound of each string to be individually processed and also allows the instrument to control a second instrument such as a music synthesizer.

U.S. Pat. Nos. 3,712,951 issued to Rickard, 4,228,715 issued to Nourney, 4,314,495 issued to Baggs and 4,491,051 issued to Barcus describe arrays of pressure-sensing transducers in the bridge of acoustic guitars. Such pressure transducers typically provide hard mechanical coupling between the strings and the bridge or body of the instrument. The tone signals produced by such pickups typically suffer from a lack of dynamic range in the low frequencies, a transduction characteristic which tends to overbrighten loud string vibrations.

U.S. Pat. Nos. 2,222,057 issued to Benioff and 4,860,625 issued to Mathews describe arrays of cantilever beam transducers, each monitoring the vibrations of a vibrating string. Cantilever beams typically produce tone signals having a good dynamic range, but they are inherently more fragile than pressure transducers and they are prone to undesirable tuning-fork effects when hard-coupled to a common base. Such effects tend to produce undesirable cancellations in the pickup signal and also tend to increase string-to-string crosstalk in separate string signals, a most undesirable characteristic in polyphonic applications.

Proximity-sensing transducers which monitor a vibrating segment of the string are not as prone to spurious mechanical resonances as electromechanical pickups. Magnetic pickups of the type commonly used in stringed musical instruments are responsive to displacements of a ferrous string within the magnetic field of the pickup. The response of such magnetic pickups is an exponential function of the actual string displacement, a non-linear response characteristic which tends to enrich the harmonic content of the resulting tone signal and which also enhances its dynamic range in the low-frequencies.

Since the vast majority of musical instrument amplification systems are designed to process tone signals produced by conventional magnetic pickups and microphones, it appears preferable for electromechanical pickups to produce tone signals exhibiting comparable dynamic and timbral characteristics.

Additionally, since acoustic instruments are the models for their electric counterparts, it appears preferable for a pickup to generate and/or to enhance desirable acoustic tonal qualities in the host instrument.

It is therefore a first object of the present invention to provide an improved electromechanical pickup saddle capable of producing a harmonic enrichment in the vibrating string of a musical instrument by mechanical interaction therewith.

It is a second object of the present invention to provide an electromechanical pickup for producing tone signals emulative of those produced by electromagnetic pickups on acoustic instruments.

It is a third object of the present invention to provide an electromechanical transducer array exhibiting low string-to-string crosstalk for use in conjunction with polyphonic audio processing systems and pitch-detection devices.

SUMMARY OF THE INVENTION

According to the invention, an elastic pickup saddle for an instrument string comprises a string-receiving element supported by a small elastic structure having an anti-nodal area spanning between at least two nodal points of support. The elastic structure may be a beam, a span, a plate or a diaphragm, or it may be a composite structure acting in a similar manner. The nodal points of the elastic structure preferably contact support points of a massive element, possibly including the bridge and the body of the instrument.

The elastic structure is mechanically biased by a force applied by the string by virtue of its tension. Torque forces may be introduced in the elastic structure by a string vibrating in a plane approximately parallel to the flexural center of the structure.

String vibrations cause vibratory motions of the elastic structure which are reflected back in the string to enrich the string vibrations. These vibratory motions of the elastic structure tend to alter the phase relationship between various harmonics as their vibratory planes change. Changes in string tension tend to twist and/or torque the elastic structure in a direction approximately parallel to the string axis, in addition to varying the applied mechanical bias. This tends to further disturb string vibrations and promotes acoustic tonal qualities in the pickup signal.

The net effect of the elastic structure's reaction to the string vibrations is typically of a frequency-modulating nature, producing a musical enrichment of the tone in the transducer signal. The mechanical interaction of the string with the elastic structure also tends to produce an improved planar response of the pickup.

A mechanico-electrical transducer element monitors the flexions of the elastic structure resulting from the disturbed string vibrations. The transducer element is preferably a strain sensor producing a signal which is proportional to displacement gradients of the elastic member. Different transducers may be used to monitor flexions of different portions of the elastic structure, in order to monitor string vibrations occuring in different vibratory planes and/or to monitor variations in string tension. The elastic structure may have one or more areas of increased flexion and may have a transducer element coupled to such an area of increased flexion.

The string-receiving element preferably maintains the string over a pre-determined location of the anti-nodal area of the elastic structure. The string-receiving element may have a high profile in order to increase the distance between the axis of the supported string and the flexural center of the elastic structure.

Alternately or additionally, the structure itself may be notched or otherwise formed to receive the string. The string-receiving element preferably distributes the pressure variations exerted by the string over a portion of the anti-nodal area monitored by the transducer element.

It is possible to change the direction of maximum sensitivity of the pickup without changing the positional relationship between the elements therein and without changing the orientation of the pickup with respect to the instrument by having different nodal points of the elastic structure resting on support points of different hardnesses.

Alternately or additionnally, an elastic structure may have different degrees of flexibility at different points of its anti-nodal area. In this manner, the flexural center of the elastic structure can be different from its geometrical center. It is thus possible to have an array of apparently identical transducers each having a different effective direction of maximum transduction sensitivity.

In a first embodiment, an elastic planar diaphragm underlies a high-profile string-receiving element which supports a vibrating string. The elastic diaphragm is variably deformed in response to string vibrations occurring in all vibratory planes, and is also deformed by changes in string tension. The string-receiving element is located over the area of maximum deflection of the elastic diaphragm. The elastic diaphragm is supported at multiple points along its periphery by a massive element.

In a second embodiment, a transducer element and a string-receiving element are offset on an elastic plate assembly, in order to provide maximum pickup sensitivity to string vibrations occurring at about 45 degrees from the plane of bowing of the string. The bottom plate is corner supported in a cavity practiced in the crown of the bridge.

In a third embodiment, an elastic span structure has a comb-shaped upper portion under lengthwise compression and a piezoelectric lower portion under a lengthwise tensional stress proportional to the contacting string's tension.

In a fourth embodiment, the elastic member is a beam supported at one end by a hard support and at the other end by a softer support, for producing an asymmetrical pickup response normally produced in acoustic instruments having an offset soundpost. A first transducer monitors string vibrations while a second transducer monitors string-tension variations.

DETAILED DESCRIPTION OF THE PREFERRED EMBODIMENTS

Figure 1:
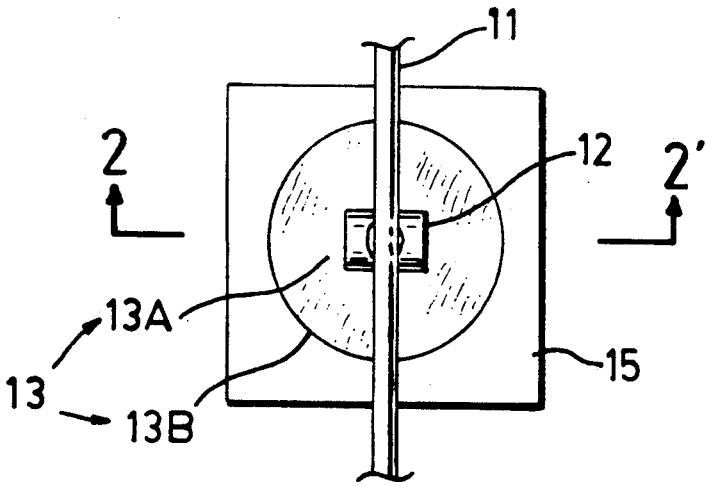
FIG. 1 is a top view of a first embodiment of a pickup according to the present invention.

In the following description and in the drawings, conductors between transducer elements and utilisation devices were omitted for clarity.

Figure 2:
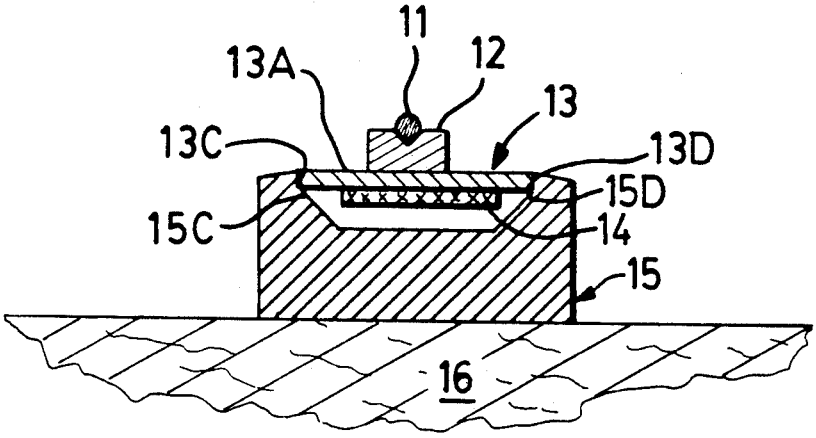
FIG. 2 is a front section view of the pickup of FIG. 1

Referring now to FIGS. 1 and 2, a playable string 11 under tension of a stringed instrument such as a guitar, contacts a notched string-support 12 fixed to, and supported by, an elastic diaphragm 13. The diaphragm 13 has an anti-nodal area 13A bordered by a substantially circular edge 13B composed of a plurality of peripheral nodal points, among which points 13C and 13D in contact respectively with corresponding support points 15C and 15D of an underlying base 15 resting on the body 16 of the instrument.

A piezoelectric element 14 is variably distorted by flexions of the diaphragm 13 to which it is fixed. The piezoelectric element 14 acts as a strain sensor responsive to stress variations of the undersurface of the anti-nodal area 13A of the diaphragm 13.

The string 11 changes direction when contacting the string support 12, thus applying a relatively static pressure on the diaphragm 13. This static pressure is a function of the string's 11 tension and also a function of the amount of break-angle made by the string 11 over the string support 12. The static pressure pre-stresses and slightly deforms the diaphragm 13. When the string 11 vibrates, the pre-stressed diaphragm 13 is further variably stressed and deformed by the string 11 vibrations. The pre-stressed diaphragm 13 preferably reacts asymmetrically to the string 11 vibrations. Since both the vibrating string 11 and the diaphragm 13 are elastic, they tend to interact and form a composite elastic structure in which music vibrations of the string 11 are disturbed by the reactions of the pre-stressed diaphragm 13, resulting in an enrichment of tone in the pickup signal.

Figure 3:
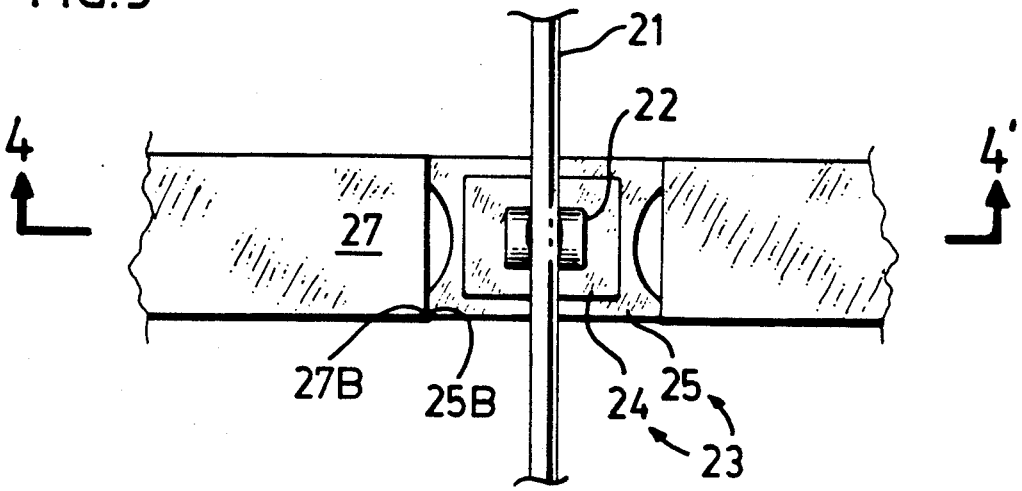
FIG. 3 is a top view of a second embodiment of a pickup according to the present invention.
Figure 4:
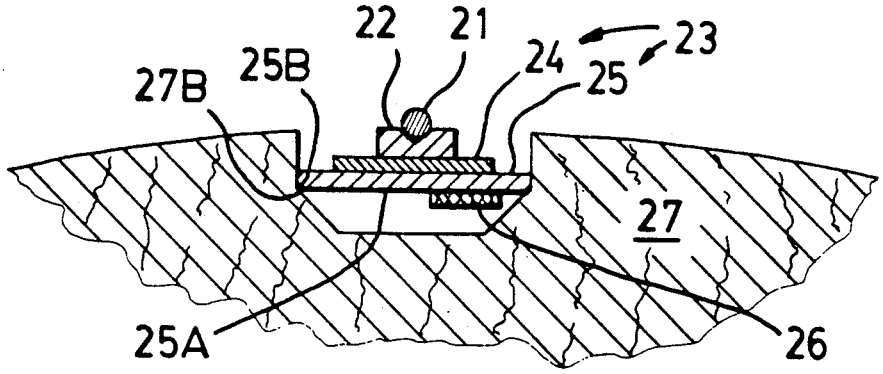
FIG. 4 is a front section view of the pickup of FIG. 3

Referring now to FIGS. 3 and 4, a playable string 21 under tension of a Cello or Bass Violin contacts a notched string-support 22 fixed to an elastic plate assembly 23 formed of a stacked pair of elastic plates 24 and 25 which function together in the manner of a multi-leaf spring, exhibiting greater effective stiffness in response to an increase in string 21 pressure. The elastic plate assembly 23 thus reacts more asymmetrically to the string vibrations than a homogenous plate. The string-support 22 has a high profile for enhancing the production of S-shaped flexions of the plate assembly 23 when the string 11 is bowed and vibrates mostly in a plane substantially parallel to that of the plate assembly 23.

The reinforcing plate 24 rests on a central portion of the anti-nodal area 25A of the main plate 25 which has four nodal corner points, among which corner point 25B in contact with a corresponding support surface 27B of a cavity practiced in the crown of the bridge 27 of the instrument.

A piezoelectric element 26 is variably distorted by the asymmetrical flexions of the main plate 25 to which it is fixed. The piezoelectric element 26 acts as a strain sensor responsive to stress variations of a portion of the undersurface of teh anti-nodal rear 25A of the main plate 25. the piezoelectric element 26 is offset with respect to the string-receiving element 22 where it is maximally responsive to vibrations approximately 45 degrees from the direction of bowing of the instrument, resulting in a pickup which is approximately equally sensitive to bowing and to plucking of the string 21.

Figure 5:
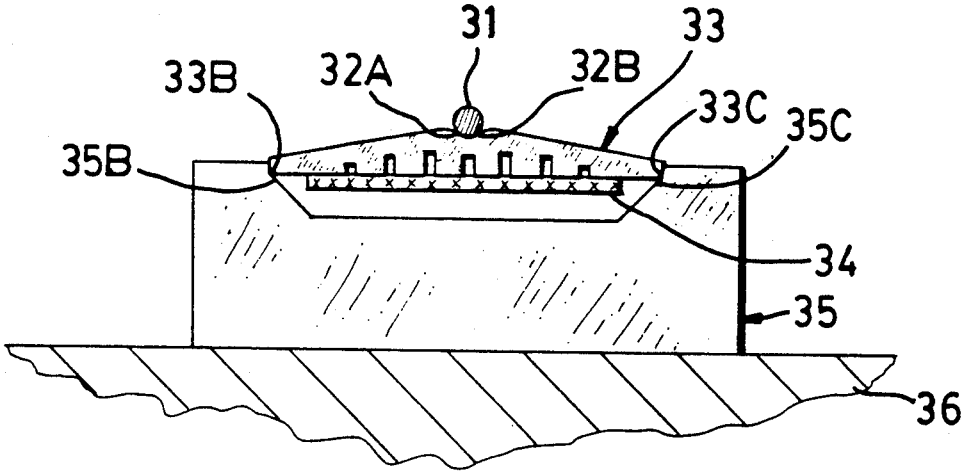
FIG. 5 is a front view of a third embodiment of a pickup according to the present invention.

Referring now to FIG. 5, a type of structure related to hollow l-beam trusses comprises an elastic comb-shaped span 33 contacting a vibrating string 31 at string-receiving points 32A and 32B. A piezoelectric crystal 34 is fixed to the underside of the comb-shaped span 33.

When the string 31 under tension exerts a downwards pressure on this composite elastic structure, the upper portion of the span 33 is under lengthwise compression while the piezoelectric crystal 34 is under a corresponding tensional stress. The transduction efficiency of this pickup is high since the piezoelectric crystal 34 is a major structural component which does not intersect the center of deflection of the elastic structure. The span 33 is supported at points 33B and 33C respectively by support surfaces 35B and 35C of a massive base resting on the body 36 of the instrument.

Figure 6:
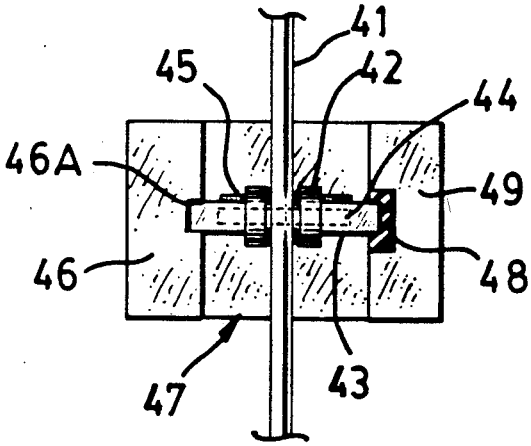
FIG. 6 is a top view of a fourth embodiment of a pickup according to the present invention.

In FIG. 6, a vibrating string 41 contacts a string-support 42 which surrounds an elastic beam 43. The string 41 applies a first pressure to the beam 43 by virtue of its tension. String 41 vibrations modulate this first pressure and cause pressure variations to be exerted on the beam 43 which further deforms correspondingly as a result. A first piezoelectric element 44 is fixed to the underside of the beam 43 to monitor primary flexural stresses in the beam caused by string 41 vibrations. A second piezoelectric element 45 is fixed to one side of the beam 43 to monitor secondary flexural stresses in the beam 43 resulting from changes in the tension of the string 41. The second piezoelectric element 45 is less sensitive to string vibrations than the first piezoelectric element 44. The tone signal from the second piezoelectric element 45 can be combined with that of the first transducer 44 in a pre-determined ratio and in the proper phase relationship, in order to reduce in the joint signal any undesirable effects caused by variations in the string 41 tension.

The elastic beam 43 is supported at one end by a hard supporting surface 46A of a first support pillar 46 fixed to a massive base 47. The elastic beam 43 is supported at the other end by a resilient insert 48 nested in the second support pillar 49 also fixed to the massive base 47. This asymmetrical support of the beam 43 tends to shift the direction of maximum sensitivity of the pickup towards the hard supporting surface 46A and also tends to scatter the vibratory planes of the string's 41 vibrations, thus tending to prevent the fundamental frequency of string 41 vibration from setting in a plane of minimum sensitivity of the first piezoelectric element 44.

Still other variations of the present invention will suggest themselves to those skilled in the Art.

For example: the elastic member can be constructed of different materials laminated into a unitary structure; the transducer means may be embedded in the elastic member; the transducer means may be an externally biased metallic strain gauge or it may be a portion of the elastic member exhibiting piezoelectric, resistive, inductive and/or capacitive changes in response to flexions of the elastic member; the transducer means may be located between the string receiving element and the elastic member; without exceeding the scope of the present invention.

It is intended therefore that the foregoing description be considered as exemplary only and that the scope of the invention be ascertained by the following claims.

What is claimed is:

1. A pickup saddle for a vibrating string under tension of a musical instrument, said pickup saddle comprising:

a node-forming string-receiving element, an elastic member having therein an anti-nodal area located between a first nodal point and a second nodal point, for supporting said node-forming string-receiving element; wherein said elastic member is first deformed by a string pressure resulting from said tension, wherein said first deformed elastic member is further variably deformed by string vibrations occurring in a plurality of vibratory planes, whereby said elastic member consequently modulates said string vibrations by mechanical interaction therewith through said string-receiving element, first rigid support means for producing said first nodal point of said elastic member by mechanical contact therewith, second rigid support means for producing said second nodal point of said elastic member by mechanical contact therewith, massive element means for impeding motions of said first and of said second nodal points of said elastic member respectively through said first and through said second support means, and mechanico-electrical transducer means having a transducer element not intersecting a flexural center of said elastic member, for converting stress variations of a flexing surface of said anti-nodal area of said further variably deformed elastic member into a transducer signal.

2. The pickup saddle of claim 1 wherein a said nodal point of said elastic member is peripheral to said anti-nodal area.

3. The pickup saddle of claim 1 wherein said elastic member is an elastic beam.

4. The pickup saddle of claim 1 wherein said elastic member is an elastic span.

5. The pickup saddle of claim 1 wherein said elastic member is an elastic plate.

6. The pickup saddle of claim 1 wherein said elastic member is an elastic diaphragm.

7. The pickup saddle of claim 1 wherein said second support means and said first support means are of different hardnesses, for controllably influencing a direction of maximum sensitivity of said pickup.

8. The pickup saddle of claim 1 wherein said anti-nodal area comprises a first flexible area and a second less flexible area.

9. The pickup saddle of claim 1 wherein said mechanico-electrical transducer means are under longitudinal tension, and wherein said elastic member is under a corresponding longitudinal compression in order to cooperate structurally for supporting said vibrating string.

10. The pickup saddle of claim 1 wherein said elastic member is composed of a plurality of superposed elastic spanning elements acting in cooperation with said string-receiving element.

11. The pickup saddle of claim 10 wherein said superposed spanning elements cooperate to increase an effective stiffness of said elastic member in response to an increased said string pressure.

* * * * *